United States Patent [19]

Flanagan

[11] 4,026,237

[45] May 31, 1977

[54] APPARATUS FOR APPLYING HOT MELT GLUE TO A SURFACE OF AN OBJECT

[75] Inventor: Thomas L. Flanagan, Killingworth, Conn.

[73] Assignee: Emhart Industries, Inc., Farmington, Conn.

[22] Filed: Oct. 1, 1975

[21] Appl. No.: 618,548

[52] U.S. Cl. ..... 118/5; 118/412

[51] Int. Cl.[2] ..... B05C 5/02

[58] Field of Search ..... 118/410, 411, 412, 2, 118/415, 5; 401/1, 2, 261, 265

[56] References Cited

UNITED STATES PATENTS

| | | | |
|---|---|---|---|
| 2,065,298 | 12/1936 | Abbott | 118/415 X |
| 2,118,415 | 5/1938 | Pesark | 401/1 |
| 2,879,176 | 3/1959 | Franck et al. | 118/415 X |
| 2,880,698 | 4/1959 | Olson | 118/412 X |
| 3,286,689 | 11/1966 | Ziemba | 118/411 |
| 3,420,208 | 1/1969 | Guthrie | 118/411 X |
| 3,509,849 | 5/1970 | Blair et al. | 118/411 X |
| 3,811,405 | 5/1974 | Baker et al. | 118/410 X |

*Primary Examiner*—John P. McIntosh
*Attorney, Agent, or Firm*—McCormick, Paulding & Huber

[57] ABSTRACT

Apparatus for applying glue to a surface of an object moving relatively to the glue applying apparatus is provided by a valve housing having a valve bore therein, the bore having a glue outlet orifice and a glue inlet, the valve housing being adapted to be disposed such that the orifice is adjacent the surface of the object upon which glue is to be applied; valve means are disposed within the valve bore for opening and closing the glue outlet orifice; and a slot is disposed in the outer surface of the valve housing in fluid communication with the orifice and oriented such that the longitudinal dimension of the slot lies substantially parallel to the direction of travel of the surface upon which glue is to be applied, the slot having a cross-sectional area which is smaller than the cross-sectional area of the glue outlet orifice, the length of the slot being sufficient to hold an amount of glue remaining in said slot after the valve means has closed the orifice until the relatively moving surface draws the glue from within the slot.

8 Claims, 7 Drawing Figures

APPARATUS FOR APPLYING HOT MELT GLUE TO A SURFACE OF AN OBJECT

BACKGROUND OF THE INVENTION

Field of the Invention. This invention relates to a glue nozzle and particularly to nondrip nozzles and glue systems for use in applying glue onto surfaces of material such as paper, cardboard, film, wood or any other material requiring gluing.

Description of the Prior Art. There are three basic methods of applying glue to the surface of material, which material is moving relatively to the glue applicator: a spraying method whereby the glue is sprayed from a nozzle located adjacent the surface; a method akin to printing, wherein the glue is "printed" onto the surface by means of a rotating wheel having recesses therein adapted to be filled with glue; and pressurized glue systems, wherein a glue nozzle touches the surface upon which glue is to be applied. One of the most perplexing problems associated with these known methods of applying glue is leakage from the glue applicator during the periods in which it is not desired to apply glue to a surface, i.e., at the end of application, shutdown of the glue applicator, etc. Another serious problem associated with pressurized gluing systems is plugging of the small glue nozzle orifices with contaminents; for example, hot melt glues undergo degradation with continual heating, causing hardened bits of glue which eventually clog the small orifices and stop the flow of glue.

SUMMARY OF THE INVENTION

The object of the present invention is to provide an apparatus for applying glue to the surface of an object, which is moving relatively to the apparatus for applying the glue, which glue applying apparatus does not leak or drip glue during those periods of operation or nonoperation when it is not desired to apply glue to the surface.

It is another object of the present invention to provide an apparatus for applying hot melt glue in which glue is supplied by gravity rather than by a pump, and an apparatus which is relatively free of clogging without the use of a large number of filters in the glue reservoir or supply lines.

In accordance with the present invention an apparatus for applying glue to the surface of an object moving relatively to the glue applying apparatus is provided by a valve housing having a bore therein, the valve bore having a glue outlet orifice and a glue inlet, the valve housing being adapted to be disposed such that the orifice is adjacent the surface of the object upon which glue is to be applied, valve means disposed within the valve bore for opening and closing the glue outlet orifice, and a slot disposed in the outer surface of the valve housing in fluid communication with the orifice, the valve housing being adapted to be disposed such that the outer surface of the valve housing having the slot disposed therein is contactable by the surface of the object upon which glue is to be applied and such that the slot is oriented so that the length of the slot lies in the direction of travel of the surface upon which glue is to be applied, the slot having a cross-sectional area which is smaller than the cross-sectional area of the glue outlet orifice, the length of the slot being sufficient to hold an amount of glue dispensed through the orifice until the moving surface draws the glue from within the slot after the valve means has closed the orifice.

In further accord with the present invention the slot may extend outwardly in two directions from the orifice and may have a total length at least twice the diameter of the orifice.

In accordance with another aspect of the invention, a glue reservoir is disposed at an elevation above that of the glue applying apparatus so that glue is fed by gravity.

The foregoing and other objects, features and advantages of the present invention will become more apparent in light of the following detailed description of a preferred embodiment thereof as illustrated in the accompanying drawings.

DESCRIPTION OF THE PREFERRED EMBODIMENT

Figure 1:
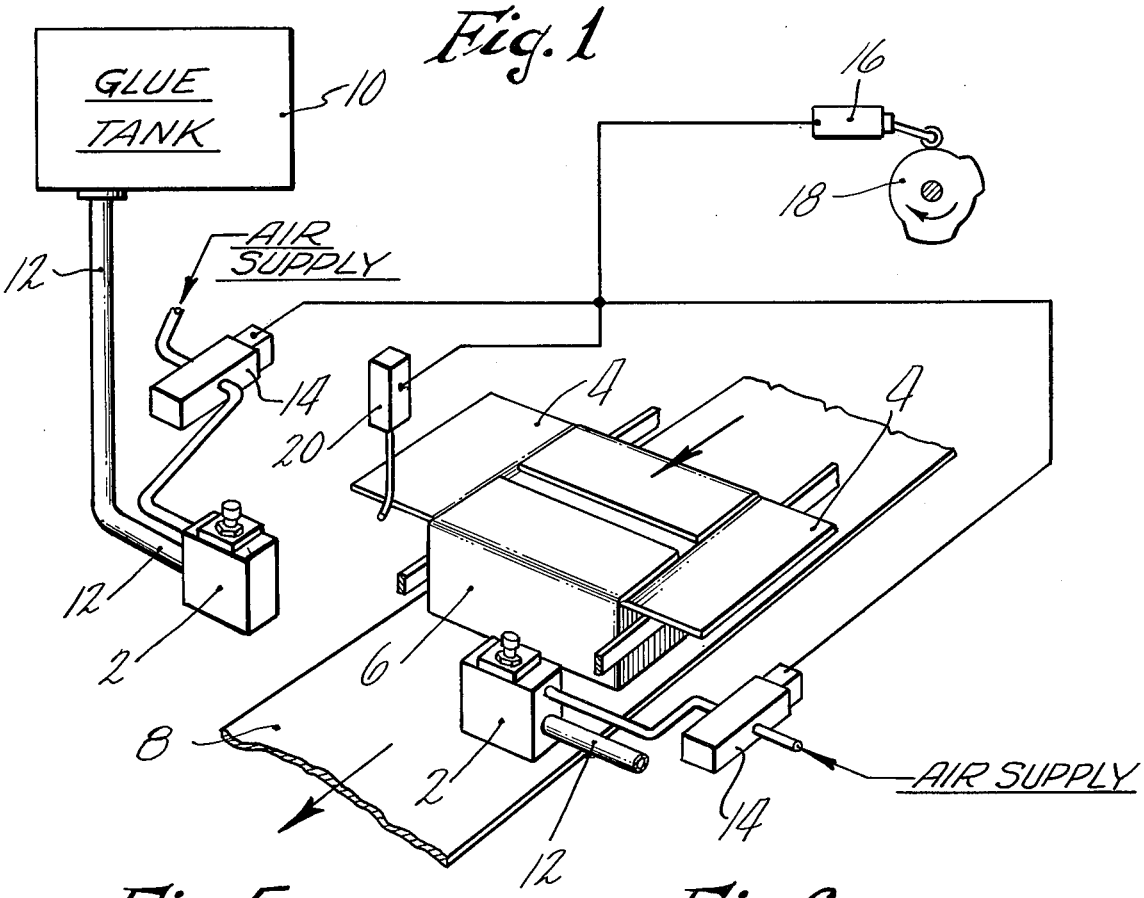
FIG. 1 is a schematic illustration of a gluing system utilizing the present invention.

Referring now to the figures, wherein like numerals refer to like components, in FIG. 1 there is shown a system for applying glue to the surface of an object moving relatively to glue applying apparatus utilizing the present invention. The apparatus for applying glue 2 (described in detail hereinafter) is arranged to apply glue to the flaps 4 of a paperboard box 6 traveling on a conveyor 8. A glue tank 10 is located above the glue applicators 2 so that the glue is able to flow by gravity through supply lines 12 to the glue applicators. The glue applicators 2 may be air operated, in which case air may be admitted thereto from air supply valves 14 which may be electrically operated valves. The operation of the valves 14 may be controlled by a switch 16 which is turned on and off by a cam 18 to control the pattern of glue applied to the flaps 4. A second switch 20 completes the electrical circuit. When the box contacts the switch 20, air will be admitted to the glue applicators and evacuated therefrom, and the glue applicators will apply glue in the desired pattern until the box 6 has passed switch 20 at which point the switch will open thereby causing the glue applicators to cease application of glue to the flaps 4.

Figure 2:
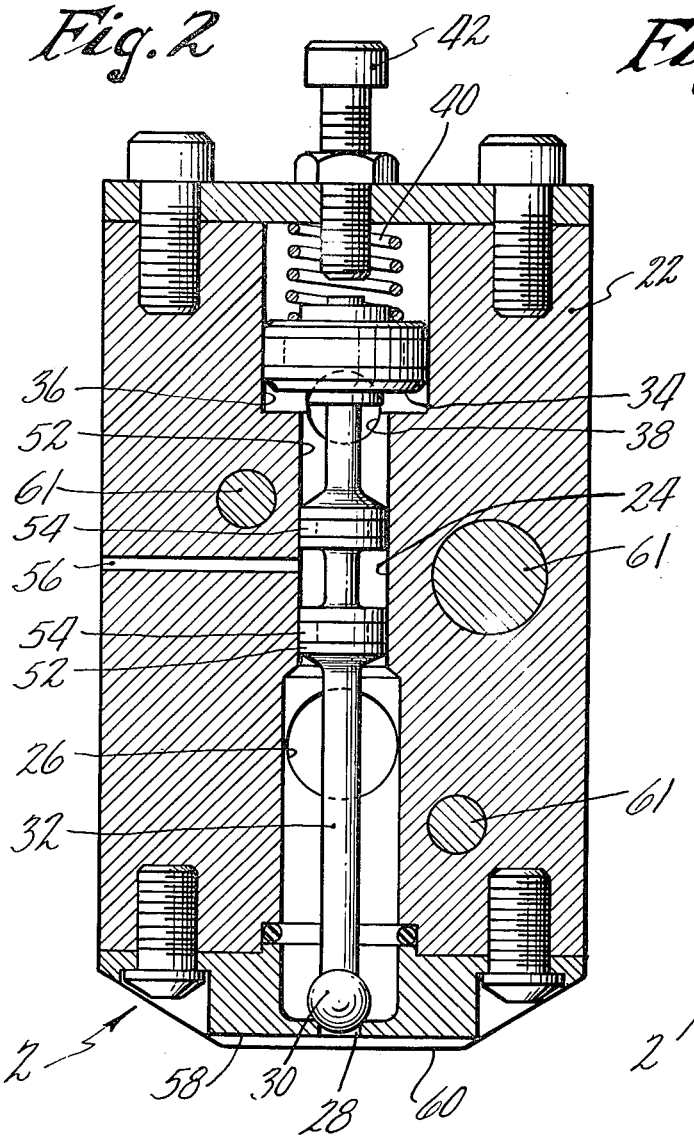
FIG. 2 is a sectional view taken along line 2—2 of FIG. 4 showing an apparatus for applying glue in accordance with the present invention.
Figure 4:
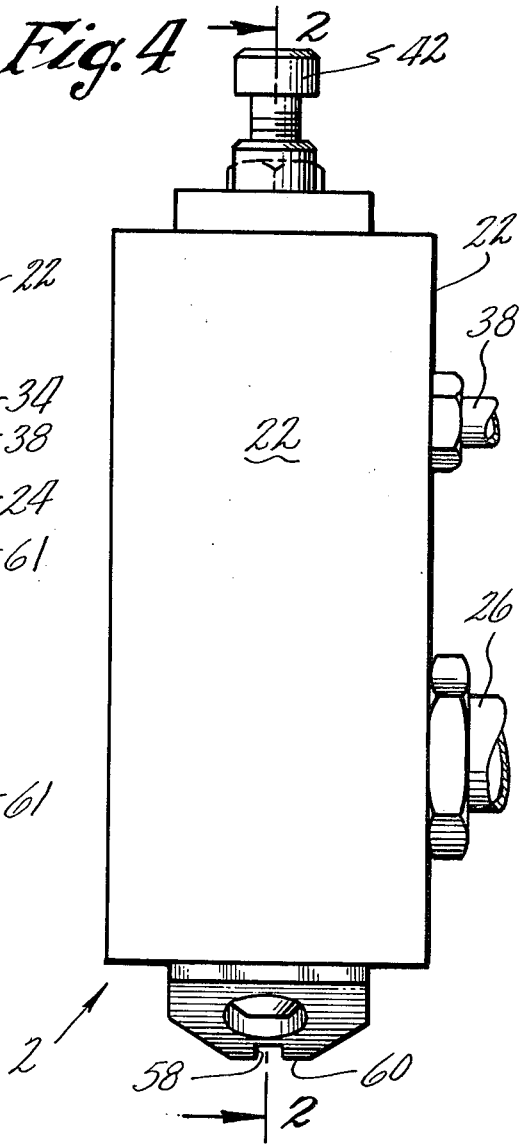
FIG. 4 is a side elevation of the apparatus for applying glue in accordance with the present invention.
Figure 3:
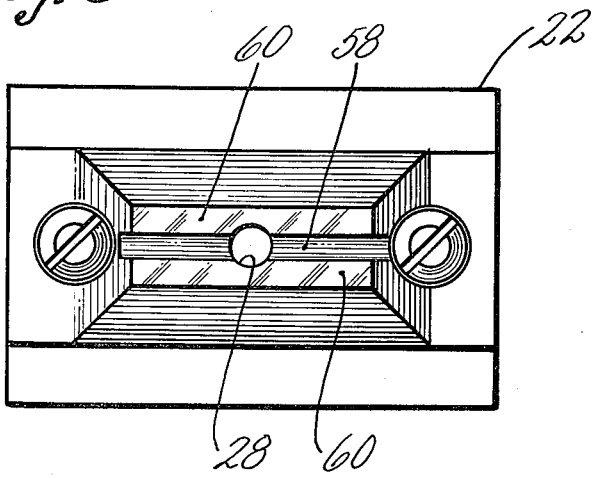
FIG. 3 is a bottom view of the apparatus for applying glue showing the slot therein in accord with the present invention.

Reference is now made to FIGS. 2–4 for a detailed description of the apparatus for applying glue in accordance with the present invention. The apparatus for applying glue shown generally at 2 comprises a valve housing 22 having a bore 24 therein; the bore 24 has a glue inlet 26 and a glue outlet orifice 28. The valve housing 22 is adapted to be disposed such that the glue outlet orifice 28 is adjacent the surface of the object upon which glue is to be applied, i.e., adjacent the surface of the box flap 4 as shown in FIG. 1. Valve means 30 is disposed within the bore 24 for cooperation with the orifice 28 to regulate the flow of glue therethrough by opening and closing the glue outlet orifice 28. The valve means 30 may be a ball type valve disposed on the end of a valve stem 32, which is reciprocably disposed within the bore 24. Means are provided for reciprocating the valve stem 32 to open and close the glue outlet orifice 28. One means by which the valve stem 32 may be reciprocated is a piston 34 disposed on the valve stem 32 within a chamber 36 in the valve housing 22. A fluid inlet 38 is provided into the chamber 36 on one side of the piston 34 and biasing means, which may be a spring 40, is disposed in the chamber 36 to urge the piston 34 in one direction. Means are provided, such as air supply valve 14, for admitting a fluid, which may be air, into the chamber 36 to overcome the spring 40 to urge the piston upwardly in the direction opposite to that which the spring 40 urges the piston, and for exhausting the air from the chamber 36 in a cyclical manner, thereby causing the valve stem 32 to reciprocate and thereby causing the valve means 30 to open and close the glue outlet orifice 28. Alternatively, reciprocation of the valve stem 32 could be accomplished by utilizing a double-acting piston; i.e., by admitting and bleeding air alternatively from both sides of the piston 34, instead of utilizing the spring 40 on one side thereof. The reciprocation of the valve means 30 on the end of the valve stem 32 serves two functions: First, the valve means 30 acts as a pump to pump the glue through the orifice; second, by regulation of the opening and closing of the glue outlet orifice 28, the glue may be applied in a "stitch pattern," i.e., a strip of glue, a space, a strip of glue, etc. The amount by which the glue outlet orifice 28 is opened as the valve means 30 is reciprocated with the valve stem 32 may be controlled by an adjustable stop means which may be a machine screw 42 threaded into housing 22 coaxially with the valve stem 32; by adjusting the screw 42, the travel of the valve stem 32, and hence the distance the valve means 30 moves away from the glue outlet orifice 28, may be controlled. Guide lands 52 may be disposed on the valve stem 32 having seals, such as O-rings 54, disposed thereon. A passage 56 is provided for the venting of any air or glue which leaks past the seals 54.

Figure 7:
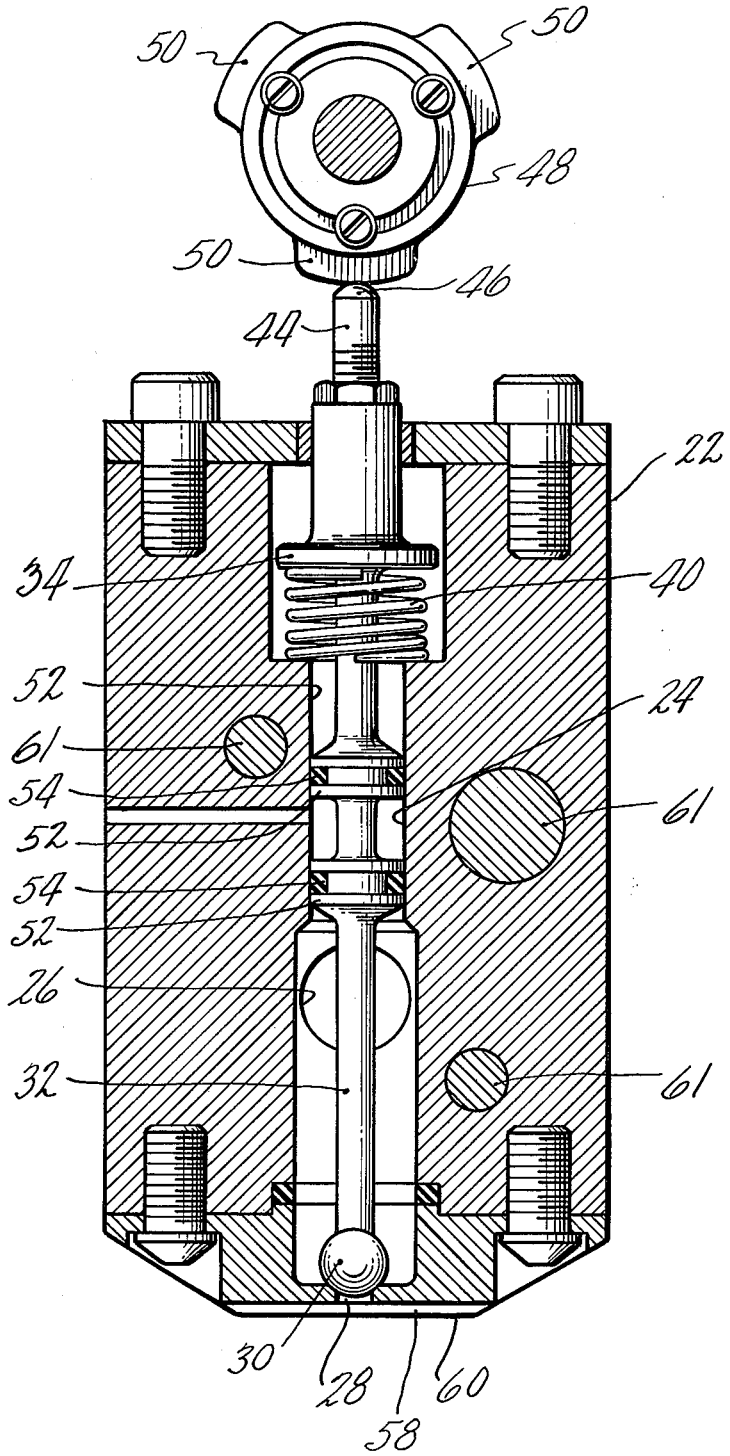
FIG. 7 is a partial sectional elevation of the apparatus for applying glue in accord with another embodiment of my invention.

The reciprocation of the valve stem 32 need not be controlled pneumatically; it can also be controlled mechanically, as shown in FIG. 7. In FIG. 7, the valve stem 32 has an extension 44 protruding from the piston 34 through the valve housing 22. The end 46 of the extension 44 is adapted to contact a rotating cam 48, which may have lobes 50 thereon. The spring 40 urges the piston, and hence the extension 44, towards the cam 48. As the cam 48 rotates, the lobes 50 will contact the end 46 of extension 44 thereby pushing the valve stem 32 away from the cam 48 in a direction which causes the valve means 30 to close the glue outlet orifice 28; as the lobe 50 passes the end 46, the spring 40 will again push the piston 34, and hence the value stem 32, towards the cam, thereby causing the valve means 30 to move away from the orifice 28, thereby opening the orifice. The reciprocation of the valve stem 32 may also be controlled by solenoid valves (not shown).

A slot 58 is disposed in the outer surface 60 of the valve housing 22 in fluid communication with the glue outlet orifice 28. The valve housing 22 is adapted to be disposed such that the outer surface 60 of the housing 22 having the slot 58 disposed therein is contactable by the surface of the object upon which glue is to be applied (e.g., the surface of the box flap 4 as shown in FIG. 1), and such that the length of the slot 58 lies in the direction of travel of the surface upon which glue is to be applied. The slot 58 has a cross-sectional area which is smaller than the cross-sectional area of the glue outlet orifice 28 and a length which is preferrably at least twice the diameter of the orifice 28. It is also preferrable that the slot 58 extends outwardly in two directions from the orifice 28. The purpose of the slot is two-fold: First, it contributes to controlling the shape of the glue pattern; and second, it serves to prevent glue from dripping from the housing 22 when the valve means 30 has closed the glue outlet orifice 28. The slot 58 has a length which is sufficient to hold an amount of glue remaining therein after the orifice 28 has been closed until the surface on which the glue is being applied, which is in contact with the outer surface 60 of the valve housing in which the slot 58 is disposed, draws the glue from within the slot 58 onto itself. With the present invention, therefore, the glue is substantially completely removed from the glue applicator after the orifice 28 has been closed and deposited on the desired surface. There is no glue remaining on the glue applicator 2 which is able to drip or leak. This feature allows the apparatus of the present invention to be utilized in any attitude. In other words, the apparatus of the present invention can be utilized, for example, to apply glue to the top surface of flaps 4 as shown in FIG. 1, and it could also be utilized to apply glue to the bottom surfaces of flaps, i.e., with the slot 58 in the outer surface 60 of the housing 22 below a surface on which it is desired to apply glue, or in an inverted position as compared to that shown in FIG. 1. Likewise, the apparatus may be utilized in a vertical position or any inclined position.

Since glue is fed to the apparatus for applying glue according to the present invention by gravity, rather than by pressurized systems known in the art, the orifice 28 may be of a relatively large size compared to glue orifices utilized in a pressurized system, e.g., 0.156 in. to 0.250 in. diameter as compared to 0.010 in. to 0.030 in. diameter. This has an advantage when using hot melt glue, especially, in that double or triple filtering between the glue tank and the glue applicator normally utilized in pressurized glue systems is not required. The glue tank utilized with the glue applicator of the present invention would need only a course screen to prevent newly added cold (solidified) glue from passing to the glue applicator because the orifice itself is large enough to allow the passage of any contaminents which may occur by virtue of the degradation of the hot melt glue. The glue orifice 28 of the present invention is, therefore, virtually free of clogging which is a frequent occurrence in pressurized systems.

Figure 5:
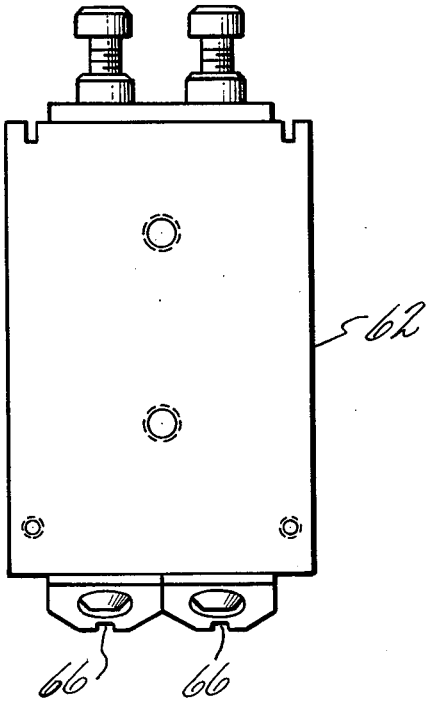
FIG. 5 is a front elevation of an apparatus for applying glue in accordance with the present invention showing a plurality of slots.
Figure 6:
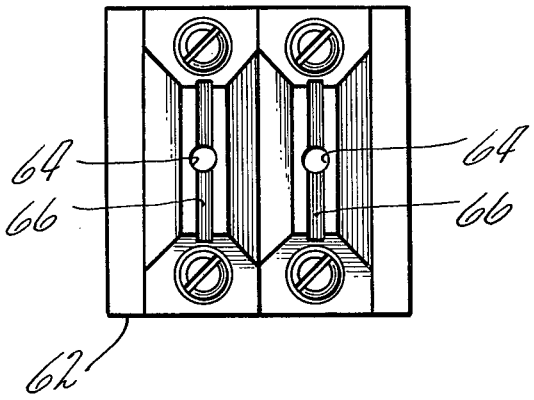
FIG. 6 is a bottom view of the apparatus shown in FIG. 5.

It may be desirable to utilize a plurality of glue applicators in a common housing. Two such glue applicators in a common housing 62 are shown in FIGS. 5 and 6 to increase the amount of glue applied to a surface. In such case each glue orifice 64 and slot 66 will have its own bore within the housing, valve means, etc.

It may be desirable, when utilizing a hot melt glue, to provide means for controlling the temperature of the housing to keep the glue passing therethrough at the proper temperature. Resistance heaters 61, for example, may be disposed within the housing and controlled by means well-known in the art to maintain the housing at a desired temperature.

There has thus been described a preferred embodiment of an apparatus for applying glue to a surface of an object moving relatively to the glue applying apparatus in accordance with the present invention. It will be understood by those skilled in the art that various changes and omissions in the detail thereof may be made therein without departing from the spirit and scope of the invention which is to be limited only as set forth in the following claims.

What I claim as new and desire to secure by Letters Patent of the United States is:

1. Apparatus for applying hot melt glue to a surface of an object moving relatively to the glue applying apparatus, comprising:

a valve housing having a bore therein, said bore terminating in a glue outlet orifice at one end thereof and having a glue inlet, said valve housing being adapted to be disposed such that said orifice is adjacent the surface upon which glue is to be applied and such that an outer surface of said valve housing is contactable by the surface upon which glue is to be applied;

a valve stem reciprocably disposed in said bore, said valve stem having valve means at one end thereof for cooperating with said orifice to control the flow of glue therethrough by opening and closing said orifice;

means for reciprocating said valve stem; and a slot disposed in said outer surface of said valve housing in fluid communication with said orifice and oriented such that the longitudinal dimension of said slot lies substantially parallel to the direction of travel of the surface upon which glue is to be applied, said slot having a cross-sectional area which is smaller than the cross-sectional area of said orifice, the length of said slot being sufficient to hold an amount of glue remaining in said slot after said valve means has closed said orifice until the moving surface draws the glue from within said slot.

2. Apparatus for applying hot melt glue to a surface of an object moving relatively to the glue applying apparatus as defined in claim 1, additionally comprising:

glue reservoir means disposed at an elevation higher than that of said valve housing; and means for connecting said glue reservoir means to said glue inlet.

3. Apparatus for applying hot melt glue as defined in claim 1, wherein said means for reciprocating said valve stem comprises:

a piston disposed on said valve stem and within a chamber in said valve housing;

fluid inlet means in said chamber on one side of said piston;

biasing means disposed in said chamber on the opposite side of said piston from said fluid inlet for urging said piston in one direction;

means for admitting a fluid into said chamber through said inlet to overcome said biasing means and to urge said piston in a direction opposite to that direction which said biasing means urges said piston; and means for exhausting fluid in said chamber.

4. Apparatus for applying hot melt glue as defined in claim 1, additionally comprising:

adjustable stop means operatively cooperating with said valve stem and said bore for controlling the position of said valve means when said valve means has opened said orifice.

5. Apparatus for applying hot melt glue as defined in claim 1, additionally comprising:

temperature control means for controlling the temperature of said valve housing.

6. Apparatus for applying hot melt glue to a surface of an object moving relatively to the glue applying apparatus, comprising:

a valve housing having a valve bore therein, said valve bore having a glue outlet orifice and a glue inlet, said valve housing being adapted to be disposed such that said orifice is adjacent the surface of the object upon which glue is to be applied;

valve means disposed within said valve bore for opening and closing said glue outlet orifice; and a slot disposed in the outer surface of said valve housing in fluid communication with said orifice, said valve housing being adapted to be disposed such that said outer surface of said valve housing having said slot disposed therein is contactable by the surface of the object upon which glue is to be applied and such that said slot is oriented so that the length of said slot lies in the direction of travel of the surface upon which glue is to be applied, said slot having a cross-sectional area which is smaller than the cross-sectional area of said orifice and a length at least twice the diameter of said orifice.

7. Apparatus for applying hot melt glue to a surface of an object moving relatively to the glue applying apparatus, comprising:

a valve housing having a valve bore therein, said valve bore having a glue outlet orifice and a glue inlet, said valve housing being adapted to be disposed such that said orifice is adjacent the surface of the object upon which glue is to be applied;

valve means disposed within said valve bore for opening and closing said glue outlet orifice; and a slot disposed in the outer surface of said valve housing in fluid communication with said orifice, said valve housing being adapted to be disposed such that said outer surface of said valve housing having said slot disposed therein is contactable by the surface of the object upon which glue is to be applied and such that said slot lies with its length along the direction of travel of the surface upon which glue is to be applied, said slot extending outwardly in two directions from said orifice and having a cross-sectional area which is smaller than the cross-sectional area of said orifice.

8. Apparatus for applying hot melt glue to a surface of an object moving relatively to the glue applying apparatus, comprising:

a valve housing having a valve bore therein, said valve bore having a glue outlet orifice and a glue inlet, said valve housing being adapted to be disposed such that said orifice is adjacent the surface of the object upon which glue is to be applied;

valve means disposed within said valve bore for opening and closing said glue outlet orifice; and a slot disposed in said outer surface of said valve housing in fluid communication with said orifice and oriented such that the longitudinal dimension of said slot lies substantially parallel to the direction of travel of the surface upon which glue is to be applied, said slot having a cross-sectional area which is smaller than the cross-sectional area of said orifice, the length of said slot being sufficient to hold an amount of glue remaining in said slot after said valve means has closed said orifice until the moving surface draws the glue from within said slot.

* * * * *